US006220012B1

(12) United States Patent
Hauser et al.

(10) Patent No.: US 6,220,012 B1
(45) Date of Patent: Apr. 24, 2001

(54) BOOSTER RECIRCULATION PASSAGEWAY AND METHODS FOR RECIRCULATING AIR

(75) Inventors: Ambrose A. Hauser, Cincinnati; Peter N. Szucs, West Chester; Jorge F. Seda, Cincinnati, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/309,014

(22) Filed: May 10, 1999

(51) Int. Cl.[7] ..... F02G 13/10
(52) U.S. Cl. ..... 60/39.02
(58) Field of Search ..... 60/39.02, 39.091, 60/226.1, 262, 39.1; 415/58.5, 58.7, 914

(56) References Cited

U.S. PATENT DOCUMENTS 5,282,718 * 2/1994 Koff et al. ..... 415/57.3
5,562,404 * 10/1996 Koff et al. ..... 415/57.4
5,607,284 * 3/1997 Byrne et al. ..... 415/58.5

* cited by examiner

*Primary Examiner*—Timothy S. Thorpe
*Assistant Examiner*—W Rodriguez
(74) *Attorney, Agent, or Firm*—Andrew C. Hess; Nathan D. Herkamp

(57) ABSTRACT

A recirculation passageway for a turbine engine provides stall protection in a booster by directing high pressure airflow from a flow path of the booster to the passageway. The high pressure airflow loses energy and decreases in pressure while traveling through the passageway until re-entry into the booster flow path. The airflow recirculates in the passageway until the airflow is discharged through a high pressure compressor.

20 Claims, 4 Drawing Sheets

BOOSTER RECIRCULATION PASSAGEWAY AND METHODS FOR RECIRCULATING AIR

BACKGROUND OF THE INVENTION

This invention relates generally to turbine engines and, more particularly, to apparatus and methods for preventing stall in a compressor.

A turbine engine typically includes a fan in front of a core engine having, in serial flow relationship, a low pressure compressor, or a booster, and a high pressure compressor. The low pressure compressor and the high pressure compressor each include an inlet section and a discharge section.

During engine power reductions, the inlet section of the high pressure compressor may generate an airflow blockage resulting from a flow differential between airflow through the high pressure compressor inlet section and the airflow through the booster discharge section. The airflow blockage generates a back pressure in the booster which causes the booster operating line to migrate closer to a stall limit. Migration of the booster operating line closer to the stall limit restricts the operating range of the turbine engine because less air continues to flow through the booster.

If the booster stalls, loud banging noises and flames or smoke may be generated at the booster inlet and/or discharge section. A booster stall condition results in excessive wear, degradation of performance, and a reduction in engine reliability and durability. In order to compensate for booster stall, the booster is typically over constructed, leading to more parts that in turn make the booster, and the resulting engine, heavier.

Booster stall is mitigated in existing engines by the use of complex variable bleed doors, or valves, which open during unsteady airflow conditions and allow a portion of the booster airflow to bypass the high pressure compressor. However, the bleed doors may fail or malfunction due to the complexity of the doors and valves.

Accordingly, it would be desirable to provide efficient booster stall protection without the added complexity of variable bleed doors. Additionally, it would be desirable to provide improved reliability of booster stall protection.

BRIEF SUMMARY OF THE INVENTION

A booster which includes a stator casing, a rotor shroud, and stator and rotor hub treatments extends the booster stall limit capability, and eliminates the need for variable bleed, or bypass, doors. More particularly, and in an exemplary embodiment, the booster includes a passageway which extends from a higher pressure portion of the booster to a lower pressure portion of the booster. The passageway includes angular slots which extend along an airflow path from the higher pressure portion of the booster to the lower pressure portion of the booster.

In operation, an airflow enters the passageway at a higher pressure portion of the booster. The airflow travels through the passageway from the higher pressure portion of the booster to the lower pressure portion of the booster, and expends energy and decreases in pressure while traveling through the passageway. The airflow then exits the passageway at the lower pressure portion of the booster and returns to the airflow path.

Recirculation of the airflow from the higher pressure portion of the booster to the lower pressure portion of the booster extends a booster stall free operating region and reduces the likelihood that the booster will reach a stall limit during engine power reductions. As back pressure diminishes, the recirculation lessens and the booster returns to a more normal operation. By eliminating the bypass doors or valves, the passageway increases engine and booster stall protection reliability.

DETAILED DESCRIPTION OF THE INVENTION

Figure 1:
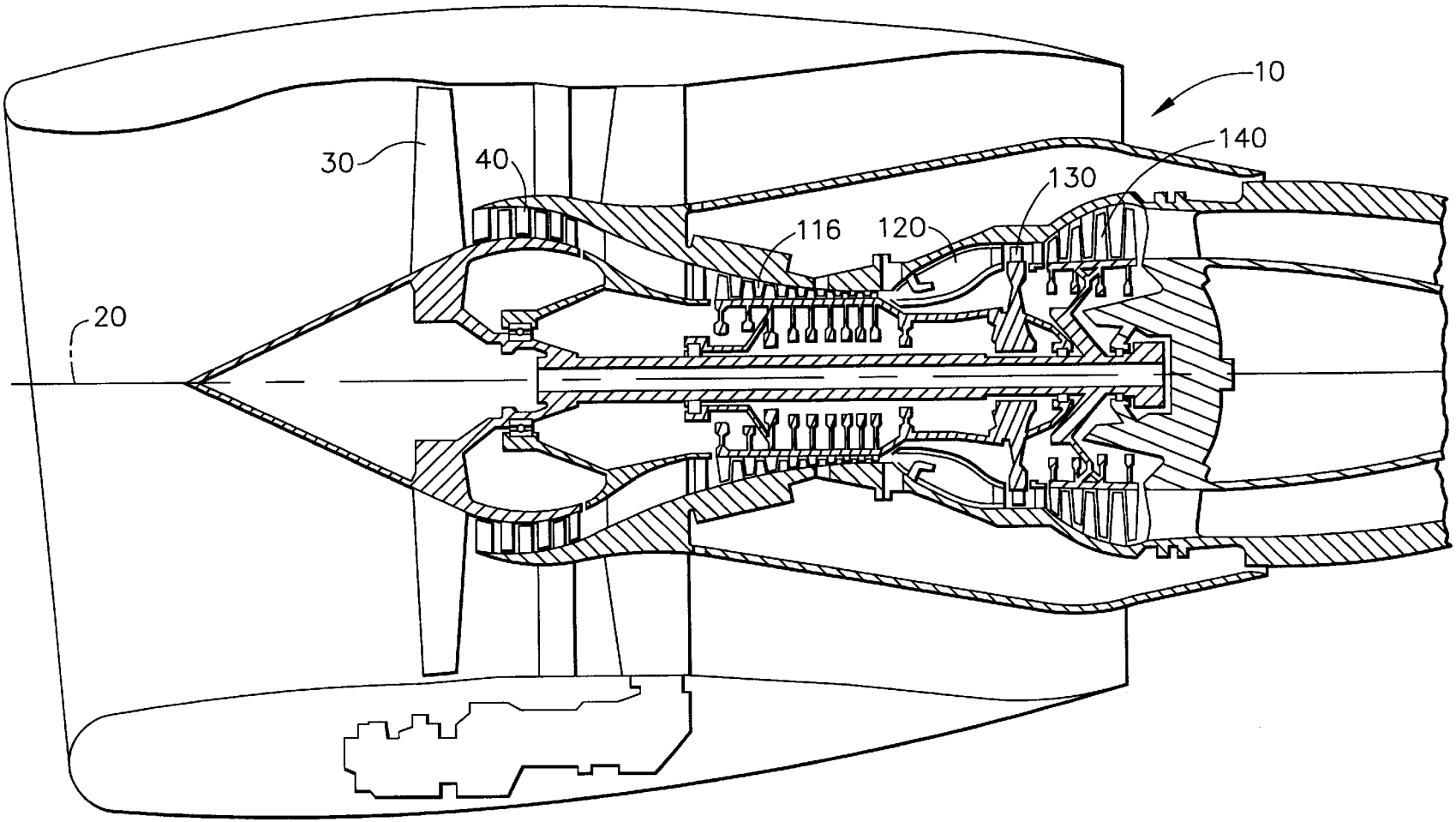
FIG. 1 is a cross sectional view of a turbine engine including a low pressure compressor.

FIG. 1 is a cross sectional view of a turbine engine 10 symmetrical about a central axis 20. Engine 10 includes, in serial flow communication, a front fan 30, a multistage low pressure compressor, or booster 40, a multistage high pressure compressor 116 which supplies high pressure air to a combustor 120, a high pressure turbine 130, and a low pressure turbine 140.

During operation of engine 10, air flows downstream through fan 30 and into multistage booster 40. The booster compresses the air and the air continues to flow downstream through high pressure compressor 116 where the air becomes highly pressurized. A portion of the highly pressurized compressed air is directed to combustor 120, mixed with fuel, and ignited to generate hot combustion gases which flow further downstream and are utilized by high pressure turbine 130 and low pressure turbine 140 to drive high pressure compressor 116, front fan 30, and booster 40, respectively.

Figure 2:
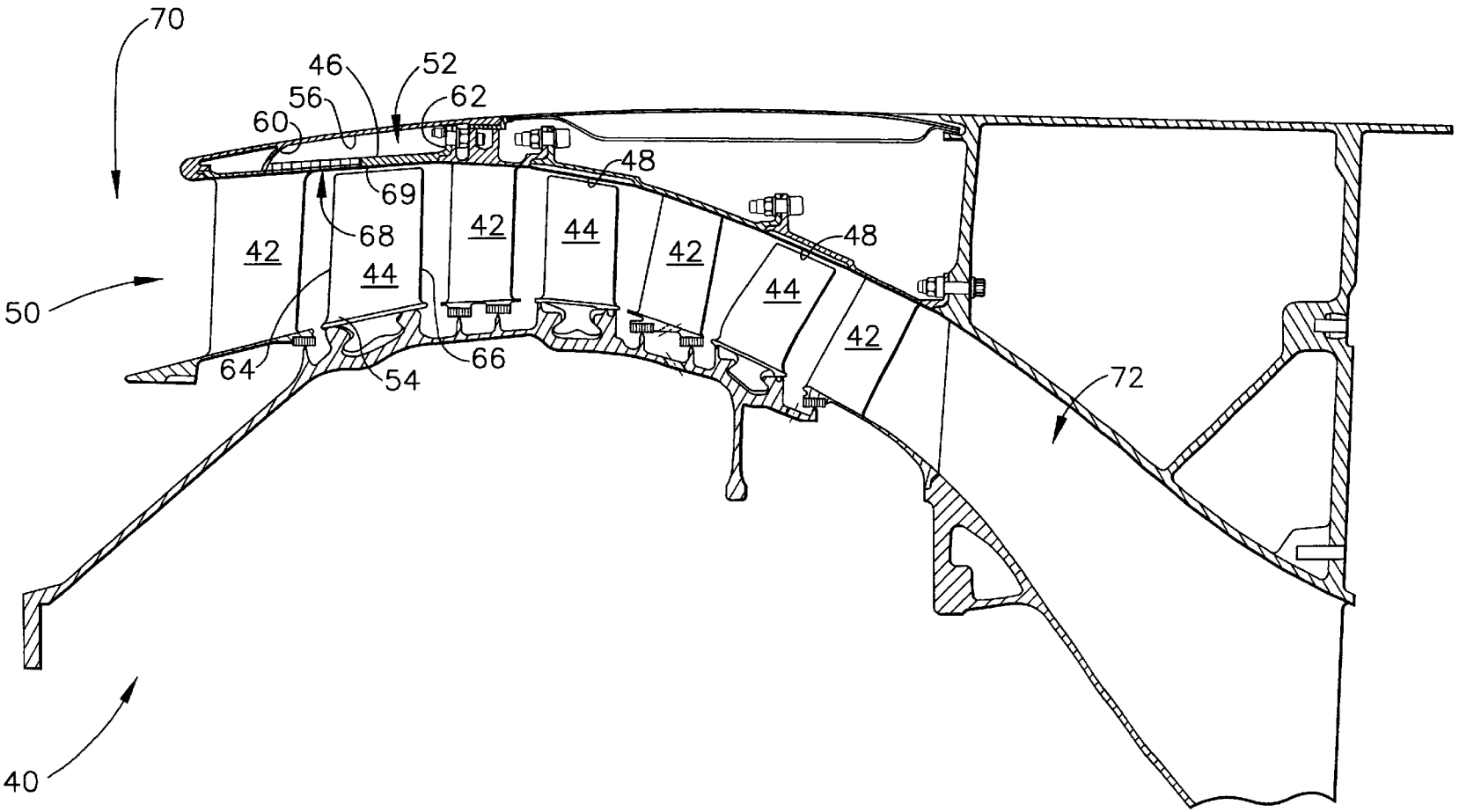
FIG. 2 is an enlarged axial sectional view of the low pressure compressor shown in FIG. 1 including a recirculating passageway.

FIG. 2 illustrates a portion of the engine shown in FIG. 1. As shown in FIG. 2, booster 40 includes a plurality of stator vanes 42 and a plurality of rotor blades 44 surrounded by a stator casing 46 and a plurality of rotor shrouds 48. A first passageway, or flow path, 50 extends through booster 40 and is formed, and defined, by stator vanes 42, rotor blades 44, stator casing 46, and rotor shrouds 48.

A second passageway, or flow path, 52 in booster 40 extends through a portion of rotor shroud 48 adjacent a forward rotor blade 54. Second passageway 52 is in flow communication with flow path 50. Booster 40 includes a first wall 56, stator casing 46, a leading edge 60, and a trailing edge 62 which form second passageway 52. First wall 56 and stator casing 46 extend substantially 360 degrees around central axis 20 of turbine engine 10 (shown in FIG. 1). First wall 56 is connected to leading edge 60 and trailing edge 62, which are also connected to stator casing 46.

Forward rotor blade 54 also includes a leading edge 64 and a trailing edge 66. A plurality of openings 68 extend through stator casing 46 and are in flow communication with second passageway 52. Openings 68 in stator casing 46 extend from leading edge 60 to a portion 69 of rotor blade 54 between leading edge 64 and trailing edge 66. First passageway 50 of booster 40 further includes an inlet, or a lower pressure portion, 70 and a discharge, or a higher pressure portion, 72.

In operation, airflow moves downstream through booster 40 along flow path 50 and increases in pressure and temperature. When fuel and high pressure airflow are decreased to combustor 120 (shown in FIG. 1), fan 30 (shown in FIG. 1), booster 40, and high pressure compressor 116 (shown in FIG. 1) decelerate. Due to a lower inertia and a higher pressure ratio, high pressure compressor 116 decelerates faster than fan 30 and booster 40. The faster deceleration of high pressure compressor 116 generates an airflow blockage that results in an increased back pressure at discharge 72, forcing an operating line of booster 40 to migrate towards a stall limit line.

The increased back pressure causes a portion of the high pressure airflow to recirculate and exit passageway 50 at a higher pressure portion of booster 40 through openings 68 and enter passageway 52. The recirculating airflow re-enters flow path 50 at a lower pressure portion of booster 40, i.e., extends the booster stall limit line. Recirculating a portion of the high pressure airflow beyond the raised operating line of booster 40 allows airflow to freely move from the higher pressure portion of booster 40 to the lower pressure portion of booster 40. The amount of recirculation varies depending on the amount of booster back pressure. For example, an increased booster back pressure results in an increased recirculating airflow and a decreased booster back pressure results in a decreased recirculating airflow.

Figure 3:
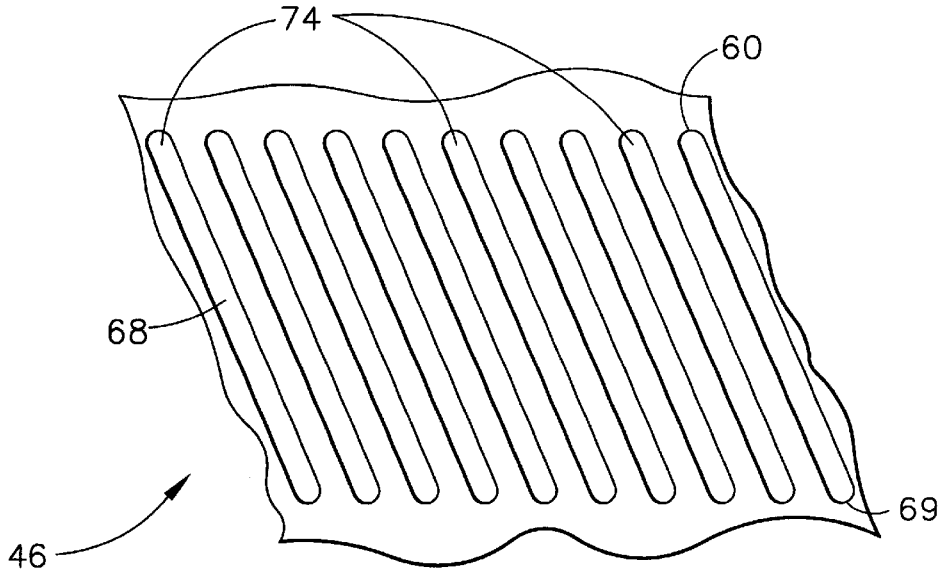
FIG. 3 is an enlarged perspective view of a portion of the recirculating passageway shown in FIG. 2.

FIG. 3 illustrates a perspective view of openings 68 shown in FIG. 2. As shown in FIG. 3, openings 68 in stator casing 46 include a plurality of angled slots 74 which extend from leading edge 60 to portion 69.

In operation, high pressure airflow enters angled slots 74 between rotor blade leading edge 64 and portion 69. The high pressure airflow travels through passageway 52 (shown in FIG. 2) until the airflow exits passageway 52 through angled slots 74 at leading edge 60. The airflow then travels downstream in flow path 50 and increases in pressure.

Figure 4:
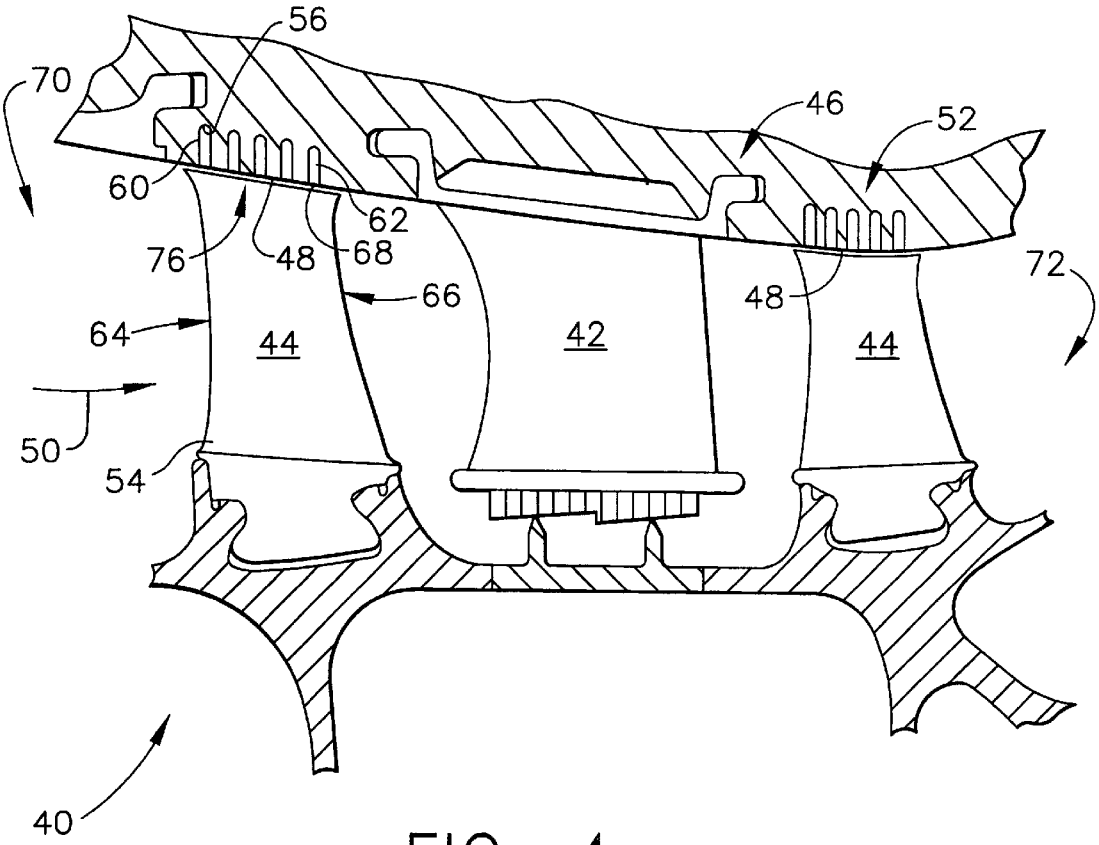
FIG. 4 is an enlarged axial sectional view of the low pressure compressor shown in FIG. 1 including a plurality of circumferential grooves.

FIG. 4 illustrates a portion of booster 40 including a plurality of circumferential grooves 76. Circumferential grooves 76 extend from leading edge 60 to trailing edge 62 in rotor shroud 48. Booster 40 includes first wall 56 and circumferential grooves 76 extend from opening 68 to first wall 56.

In operation, a portion of a wake fluid enters a downstream circumferential groove 76 between rotor blade leading edge 64 and trailing edge 66 at openings 68 when the high pressure airflow reverses flow direction and flows upstream in booster 40. The wake fluid then progresses upstream in booster 40 and enters an adjacent groove 76. The upstream progression of the wake fluid continues until either the high pressure airflow again flows downstream or the wake fluid extends upstream beyond grooves 76 and booster stall occurs. Grooves 76 extend the stall line of booster 40 and increase the operating range of booster 40.

Figure 5:
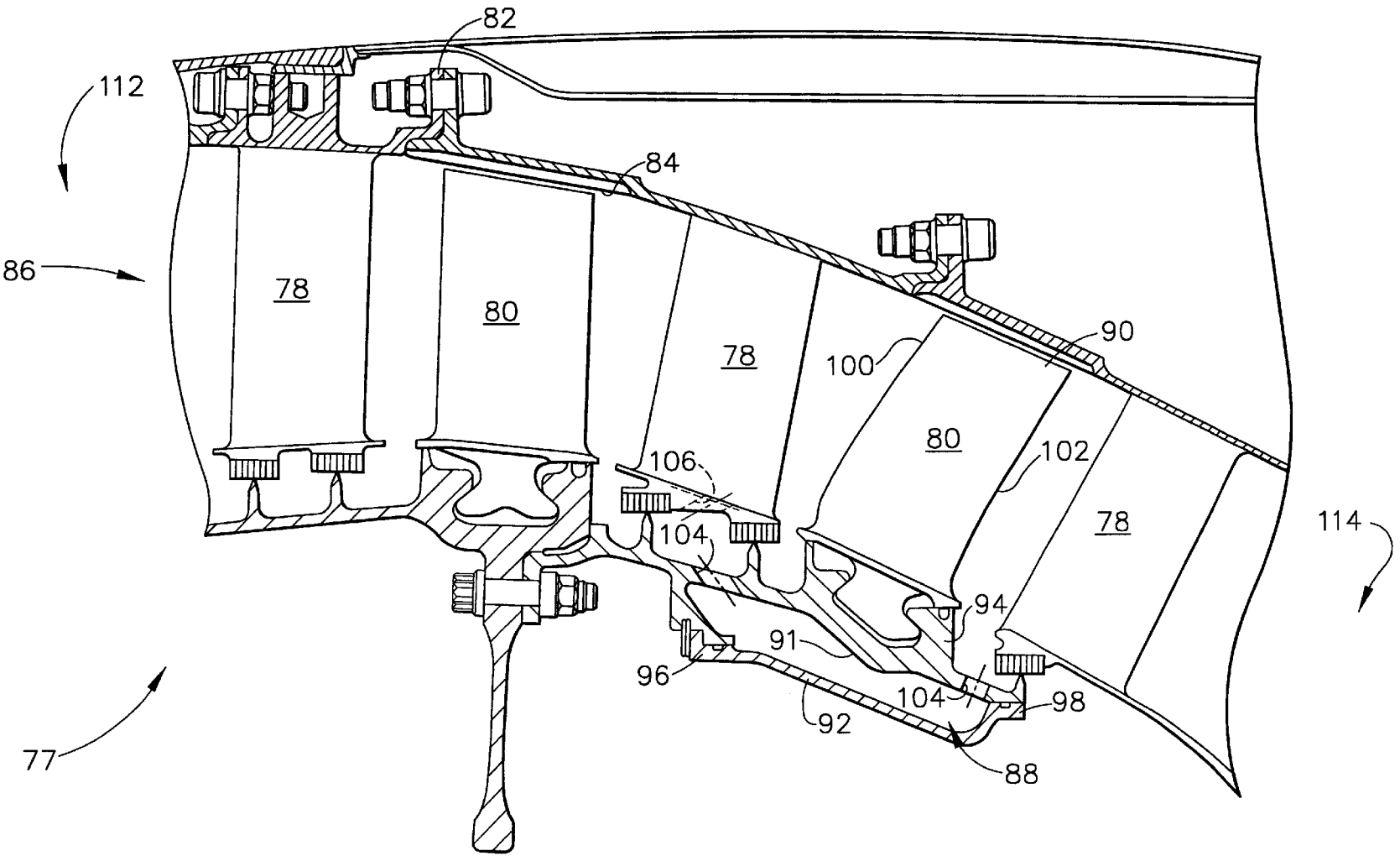
FIG. 5 is an enlarged axial sectional view of the low pressure compressor shown in FIG. 1 including an alternative recirculating passageway.

FIG. 5 illustrates a booster 77 including a plurality of hub stator vanes 78 and a plurality of hub rotor blades 80 surrounded by a hub stator casing 82 and a plurality of hub rotor shrouds 84.

A first passageway, or flow path, 86 extends through booster 77 and is formed, or defined, by hub stator vanes 78, hub rotor blades 80, hub stator casing 82, and hub rotor shrouds 84. Booster 77 further includes a second passageway 88 and an aft hub rotor blade 90 connected to a rotor shaft 91. Second passageway 88 extends through a portion of rotor shaft 91. Rotor shaft 91 includes a first wall 92 and a second wall 94 which extend 360 degrees. Second passageway 88 is in flow communication with flow path 86 and is bounded by first wall 92 and second wall 94.

Rotor shaft 91 further includes a leading edge 96 and a trailing edge 98. First wall 92 is connected to leading edge 96 and trailing edge 98 which are connected to second wall 94. First wall 92, second wall 94, leading edge 96, and trailing edge 98 form second passageway 88. Aft hub rotor blade 90, located in the hub of booster 77, includes a leading edge 100 and a trailing edge 102. Second wall 94 comprises a plurality of openings 104 in flow communication with second passageway 88 and an opening 106 in hub stator vane 78 adjacent aft hub rotor blade 90.

In one embodiment, openings 104 and 106 in second wall 94 and in hub stator vane 78 adjacent aft hub rotor blade 90 comprise a plurality of circular apertures (not shown). Booster 77 also includes an inlet 112 located at an area of lower pressure, and a discharge 114 located at an area of higher pressure.

The embodiment of Booster 77 shown in FIG. 5 maintains stability in boosters that have their aerodynamic stability limitations in the hub region. When booster 77 has raised operating line conditions, increased recirculation through second passageway 88 keeps the hub region pressure at trailing edge 102 of hub rotor blades 80 from attaining a stability limit level. This increased recirculation maintains booster 77 in a stable, i.e., a stall free, operation at the raised operating line condition.

The recirculation passageway is formed in the existing structure of the turbine engine and adds minimal cost and complexity to the booster. The inclusion of the recirculating passageway in the booster protects against booster stall and improves the reliability of operation when compared to variable bleed valves or doors which may stick or function improperly.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine engine comprising:

at least one compressor comprising a first passageway extending therethrough, said compressor comprising a plurality of stator vanes and a plurality of rotor blades extending into said first passageway, said compressor further comprising a stator casing and a plurality of rotor shrouds surrounding said stator vanes and rotor blades, said passageway further comprising a higher pressure portion and a lower pressure portion, each said rotor blade comprising a leading edge and a trailing edge; and a second passageway in flow communication with said first passageway, said second passageway extending from said higher pressure portion of said first passageway to said lower pressure portion of said first passageway, said second passageway comprising an inlet and an outlet, said inlet downstream from said outlet and located downstream of said rotor blade trailing edge and upstream an adjacent downstream stator vane.

2. A turbine engine in accordance with claim 1 wherein said compressor further comprises:

a first wall and a second wall bordering said second passageway;

a leading edge and a trailing edge connecting said first wall and said second wall;

a combustor in flow communication with said first passageway; and at least one turbine in flow communication with said combustor.

3. A turbine engine in accordance with claim 2 further comprising:

a stator platform connected to said stator vanes; and a rotor shaft connected to said plurality of rotor blades, said rotor shaft further connected to said turbine.

4. A turbine engine in accordance with claim 3 wherein said second wall comprises a plurality of openings in flow communication with said first passageway and said second passageway.

5. A turbine in accordance with claim 4 further comprising a plurality of angled slots extending from a leading edge of each said rotor shroud to a trailing edge of each said rotor shroud.

6. A turbine engine in accordance with claim 4 wherein said plurality of openings comprises a first opening and a second opening.

7. A turbine engine in accordance with claim 5 wherein said rotor shroud comprises said second wall and at least a portion of said compressor leading edge and said compressor trailing edge.

8. A turbine engine in accordance with claim 7 wherein said stator casing comprises said first wall and at least a portion of said compressor leading edge and said compressor trailing edge.

9. A turbine engine in accordance with claim 6 wherein said rotor shaft comprises said first wall, said second wall, said compressor leading edge, and said compressor trailing edge.

10. A method for providing recirculation of airflow in a turbine engine which includes at least one compressor, the compressor includes a plurality of stator vanes and a plurality of rotor blades surrounded by a stator casing and a plurality of rotor shrouds, said method comprising the steps of:

operating the turbine engine to direct the airflow through the compressor;

increasing the pressure of the airflow in the compressor; and directing a portion of the pressurized airflow through a passageway from a higher pressure portion of the compressor to a lower pressure portion of the compressor, such that the pressurized airflow enters an inlet of the passageway which is located downstream of the rotor blade trailing edge and upstream an adjacent downstream stator vane.

11. A method in accordance with claim 10 wherein said step of directing comprises the step of directing a portion of the pressurized airflow through the rotor shrouds.

12. A method in accordance with claim 10 wherein said step of directing comprises the step of directing a portion of the pressurized airflow through the stator casing.

13. A method in accordance with claim 10 wherein the compressor further includes a rotor shaft connected to the rotor blades, said step of directing comprises the step of directing a portion of the pressurized airflow through the rotor shaft.

14. A method in accordance with claim 10 wherein the compressor further includes a plurality of stator platforms connected to the stator vanes, said step of directing comprises the step of directing a portion of the pressurized airflow through the stator vane platform.

15. A compressor comprising:

a first flow path through said compressor, said flow path including a higher pressure area and a lower pressure area;

a plurality of stator vanes and a plurality of rotor blades positioned within said flow path;

a stator casing and a plurality of rotor shrouds surrounding said stator vanes and rotor blades; and a second flow path in flow communication with said higher pressure area and said lower pressure are of said first flow path, said second flow path comprising an inlet and an outlet, said inlet at said rotor blade trailing edge.

16. A compressor in accordance with claim 15 further comprising a first wall, a second wall, a leading edge, and a trailing edge, said second flow path bounded by said first wall and said second wall, said first wall connected to said compressor leading edge and said compressor trailing edge which are connected to said second wall, said second flow path comprising a plurality of angled slots.

17. A compressor in accordance with claim 16 wherein said second wall comprises a plurality of openings in flow communication with said higher pressure area and said lower pressure area.

18. A compressor in accordance with claim 17 wherein said plurality of angled slots extend from a leading edge of each said rotor shroud to a trailing edge of each said rotor shroud.

19. A compressor in accordance with claim 18 wherein said rotor shroud comprises said second wall and at least a portion of said compressor leading edge and said compressor trailing edge.

20. A compressor in accordance with claim 19 wherein said stator casing comprises said first wall and at least a portion of said compressor leading edge and said compressor trailing edge.

* * * * *